US005411099A

United States Patent [19]

Braddick

[11] Patent Number: 5,411,099

[45] Date of Patent: May 2, 1995

[54] WELL TOOL AND METHOD

[76] Inventor: Britt O. Braddick, 1038 Martin, Houston, Tex. 77018

[21] Appl. No.: 158,993

[22] Filed: Nov. 30, 1993

[51] Int. Cl.[6] ..... E21B 43/00

[52] U.S. Cl. ..... 166/387

[58] Field of Search ..... 166/387, 377, 378, 381-383, 166/386

[56] References Cited

U.S. PATENT DOCUMENTS

| | | | |
|---|---|---|---|
| 4,281,711 | 8/1981 | Braddick et al. | 166/118 |
| 4,794,989 | 1/1989 | Mills | 166/387 |
| 4,832,129 | 5/1989 | Sproul et al. | 166/387 |
| 4,834,185 | 5/1989 | Braddick | 166/382 |
| 4,848,459 | 7/1989 | Blackwell et al. | 166/387 X |
| 4,898,245 | 2/1990 | Braddick | 166/387 |
| 5,018,579 | 5/1991 | Braddick et al. | 166/291 |
| 5,095,978 | 3/1992 | Akkerman et al. | 166/387 X |

*Primary Examiner*—Michael Powell Buiz
*Attorney, Agent, or Firm*—Jack W. Hayden

[57] ABSTRACT

A liner (L) includes a well tool, or liner portion (LP) which may be connected anywhere in the longitudinal extent of the liner (L) that is overlapped by a well bore tubular member. The well tool includes a liner hanger (LH) and packer (P) thereon which are releasable sequentially by manipulating the liner (L), or liner portion (LP) to secure the liner hanger (LH) with the well bore tubular member (C) without actuating the packer (P) until it is desired to do so, even though weight may be applied to the packer (P) during the above operations. The packer is set and secured below the cement which is above the packer by manipulating the liner.

7 Claims, 6 Drawing Sheets

FIG. 9
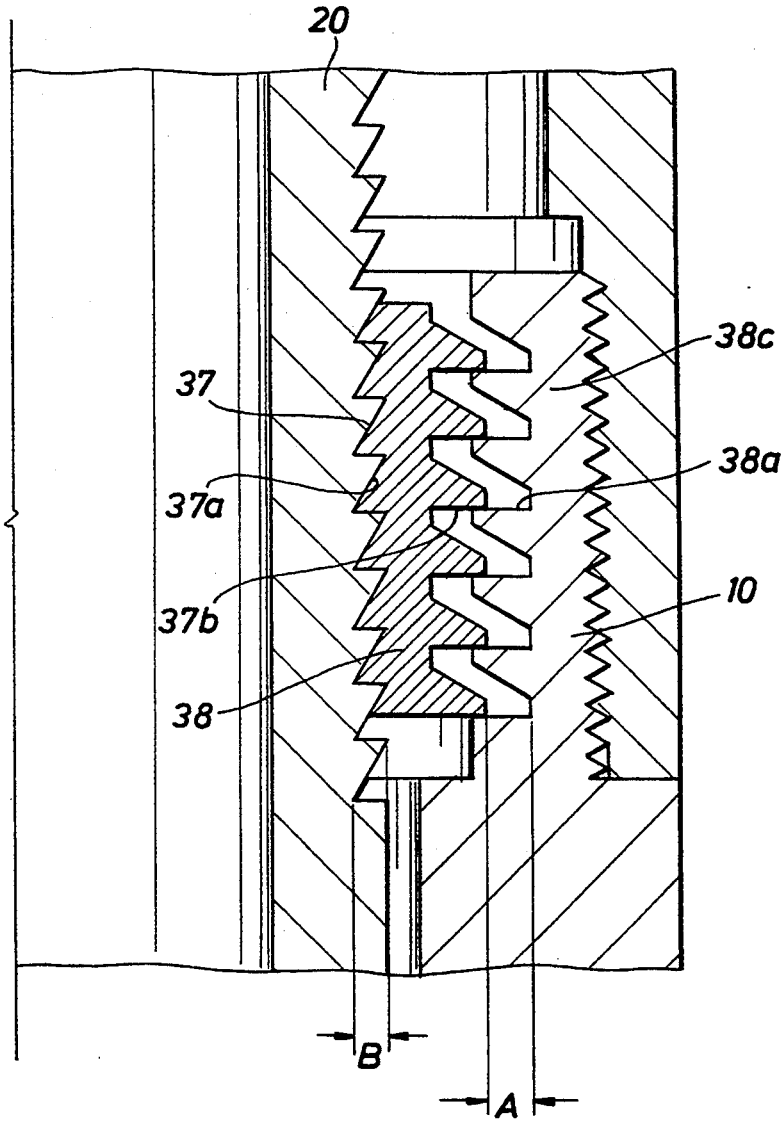
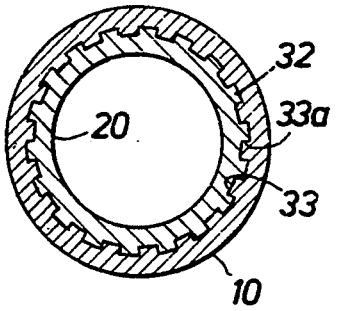
FIG. 10
FIG. 11
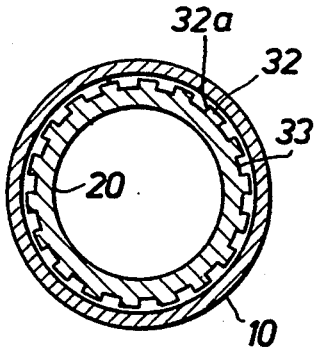

WELL TOOL AND METHOD

STATEMENT OF THE PRIOR ART

Various types of liner setting tools have been and are presently employed to secure a liner in a well bore tubular member such as a casing adjacent the upper end of the overlap of the casing and liner as illustrated in FIG. 1 of the drawings. The procedure has heretofore been accomplished, so far as known to applicant, by an operating string OS which is lowered from the earth's surface into the well bore with a setting tool on the lower end of the operating string. The setting tool includes a setting nut which releasably connects the operating string with a setting collar SC on a liner at the upper end of the liner in the casing as illustrated generally in FIG. 1 of the drawings.

The well bore, if desired, is conditioned by circulation through the operating string along with rotation, and/or reciprocation of the operating string and releasably connected liner. The liner is then secured to the well bore tubular member by manipulating the operating string to engage a liner hanger LH on the liner L with the well bore tubular member adjacent the upper end of the overlap as illustrated in FIG. 1 of the drawings. The setting tool and operating string are then disconnected from the setting collar on the liner while maintaining sealed fluid communication therewith. Cement is then conducted through the operating string into the liner and discharged from the liner lower end to flow to the annular space between the liner and the well bore tubular member to provide a seal between the liner and the well bore and between the liner and a well bore tubular member.

Heretofore, so far as known to applicant, it has been standard practice to secure the liner to the well bore tubular member by the liner hanger means and to then set a packer above the liner hanger means and above the cement in the well bore and above the cement between the well bore tubular member and the liner by securing the liner hanger means LH and packer P at the top of of the overlap portion of the casing and liner as illustrated in FIG. 1 of the drawings.

However, where there is a thief, or lost circulation zone in the well bore below the packer, the cement that has been placed between the liner and the well bore, or between the liner and a well bore tubular member and beneath the packer as shown in FIG. 1, may be, and in some instances has been lost to the thief, or lost circulation zone.

Applicant is not aware of any liner that includes a liner portion, or well tool, which liner portion, or well tool, includes a packer and a liner hanger which may be positioned at any desired elevation in the liner that is overlapped by the casing ( herein sometimes referred to as "liner overlap") so that the liner or liner portion may be manipulated by the setting tool for selectively engaging the packer and a liner hanger with the casing.

SUMMARY OF THE INVENTION

One object of the invention is to provide apparatus and method for providing and maintaining a better cement seal between a liner and well bore tubular member surrounding the liner and between the liner and the well bore.

A further object of the invention is to provide a liner portion having liner hanger means and packer means which liner portion may be incorporated as part of the liner in any location in the liner overlapped by the casing, or a well bore tubular member and which liner portion may be operated by an operating well string, or drill string, which engages a liner setting collar adjacent the upper end of the liner, or adjacent the upper end of the liner portion.

A further object of the invention is to provide a liner including a well tool having liner hanger means and packer means thereon which well tool functions as a liner portion and may be incorporated as part of the liner in any location in the liner overlap, and which well tool is operated by the liner with a liner setting collar to selectively set the liner hanger means and packer means at a predetermined, or desired location in the liner overlap in a well bore tubular member.

Yet another object of the present invention is to provide a well tool having liner hanger means and packer means thereon which well tool can be connected with a liner anywhere in the overlap of the liner to form a portion of the liner, and the liner and connected well tool then lowered into a well bore on an operating string or drill string and the well string, or drill string along with the liner and well tool thereon employed to selectively actuate the liner hanger means to secure the liner in a well bore tubular member within the overlap and then actuate the packer means to engage the well bore tubular member within the overlap.

A further object is to employ a liner having a well tool with packer means and liner hanger means thereon to manipulate the liner to operate the well tool to first set the liner hanger means in a well bore tubular at a desired location anywhere in the overlap of the well tool and liner by the well bore tubular member and later manipulate the liner to operate the well tool to actuate the packer to engage the well bore tubular member.

An object of the present invention is to secure a liner to an overlapping well bore tubular member by hanger means, conduct cement through an operating string communicating with the liner and into a space between the liner and the well bore tubular member to a desired height above unset packer means on the liner and then engaging the unset packer means with the well bore tubular member to trap or retain the cement in place above the packer means between the liner and well bore tubular member.

A still further object of the invention is to provide a liner with a liner portion which may be incorporated as part of the liner in any location in the liner overlap, and which liner portion is operated by an operating string which engages a liner setting collar adjacent the upper end of the liner portion to selectively set liner hanger means and packer means on the liner hanger portion at a predetermined, or desired location in the liner overlap within a well bore tubular member.

A still further object is to provide apparatus and method for selectively setting liner hanger means and packer means supported on a liner adjacent the lower end of the liner overlap within a well bore tubular member.

Another object is to provide apparatus and method for selectively setting liner hanger means and packer means supported on a liner adjacent the lower end of the liner overlap within a well bore tubular member, such as a casing C, by a setting tool arrangement which engages a setting collar adjacent the upper end of the liner overlap.

A further object of the invention is to provide apparatus and method for selectively setting liner hanger means and packer means that are at any position within the longitudinal extent of a liner overlap within a well bore casing.

A further object of the invention is to provide apparatus and method for selectively setting liner hanger means and packer means that are at any position throughout the longitudinal extent of a liner overlap by manipulation of the liner, or by manipulation of the liner portion on which the liner hanger means and packer means is supported.

A further object of the invention is to provide apparatus and method for selectively setting liner hanger means and packer means that are at any position throughout the longitudinal extent of a liner overlap by manipulation of an operating string that is connnected with the liner remote from the liner hanger means and packer means.

Another object of this invention is to provide a well tool which can be positioned , or connected, at any desired location between longitudinally extending liner portions which form the longitudinal extent of the liner overlap. The well tool is actuated to secure the liner with the well bore tubular member within the overlap for conducting cementing operations to conduct cement to a predetermined location, above or below a weight set, or weight actuated packer on the tool, and retain the weight set, or weight actuated packer on the liner tool disengaged from the well bore tubular member, even though the packer may be subjected to weight during the operations prior to the time it is desired to set the packer.

An object of the present invention is to provide a well tool which may be secured and actuated at any longitudinal position within the longitudinal extent of a liner overlap.

Yet another object of the invention is to provide apparatus and method for maintaining a weight set packer on a tool retracted from engaging a well bore tubular member that overlaps a liner even though weight is applied to the packer during manipulation of the tool to set a liner hanger until it is desired to engage the packer with the well bore tubular member.

Yet another object of the invention is to provide apparatus and method for maintaining a weight set packer on a well tool retracted from engaging a well bore tubular member even though weight is applied to the packer during manipulation of the well tool until it is desired to engage the packer with the well bore tubular member by manipulating the well tool from a location substantially remote relative to the location of the packer.

Other objects and advantages of the invention will become more apparent from a consideration of the following drawings and description.

BRIEF DESCRIPTION OF THE DRAWINGS

FIG. 9 is an enlarged sectional view of the circled lock means LK shown in in FIG. 2A which secures the packer engaged with the overlapping well bore tubular member;

FIG. 10 is a cross sectional view on the line 10—10 of FIG. 2A illustrating the position of spline arrangements when they are engaged; and FIG. 11 is a sectional view on the line line 11—11 of FIG. 8 illustrating the position of the spline arrangements when they are disengaged.

DESCRIPTION OF THE PREFERRED EMBODIMENTS

The well tool of the present invention will be described in detail in its use and application in setting a liner and a packer in a well bore tubular member which overlaps, or surrounds the liner; however such description is by way of example only and not by way of limitation as the well tool may be employed in other situations.

Figure 1:
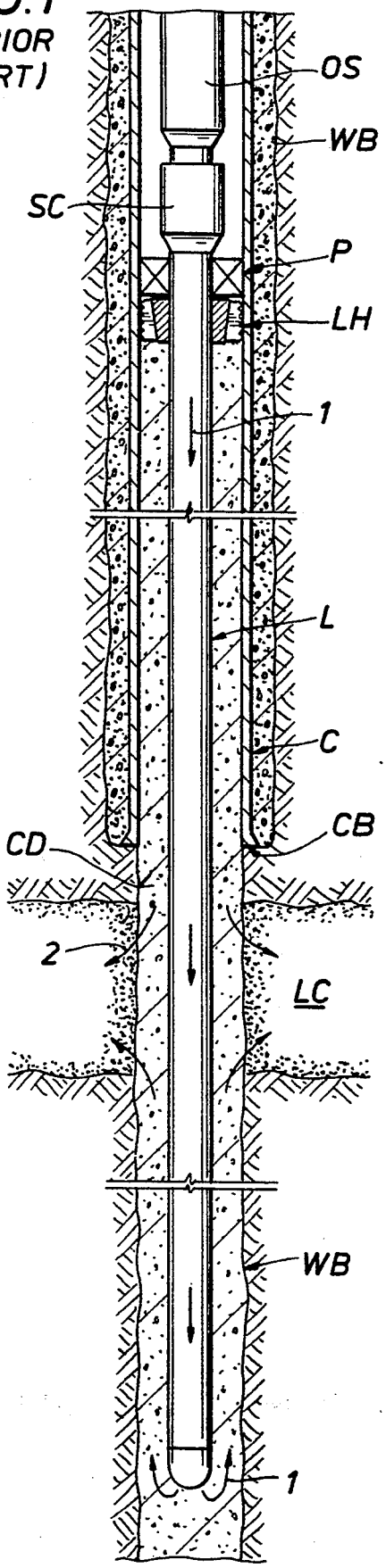
FIG. 1 (PRIOR ART)
FIG. 1 is a schematic representation of the prior art arrangement for cementing a liner in a well bore tubular member.

U.S. Pat. No. 4,834,185 in FIG. 1 shows one form of a setting tool supported on an operating string and releasably engaged with a liner. The setting tool includes clutch means in the form of rigid spline means which may be engaged with clutch means in the form of rigid spline means on the setting collar which may be employed for rotating the liner.

Figure 2:
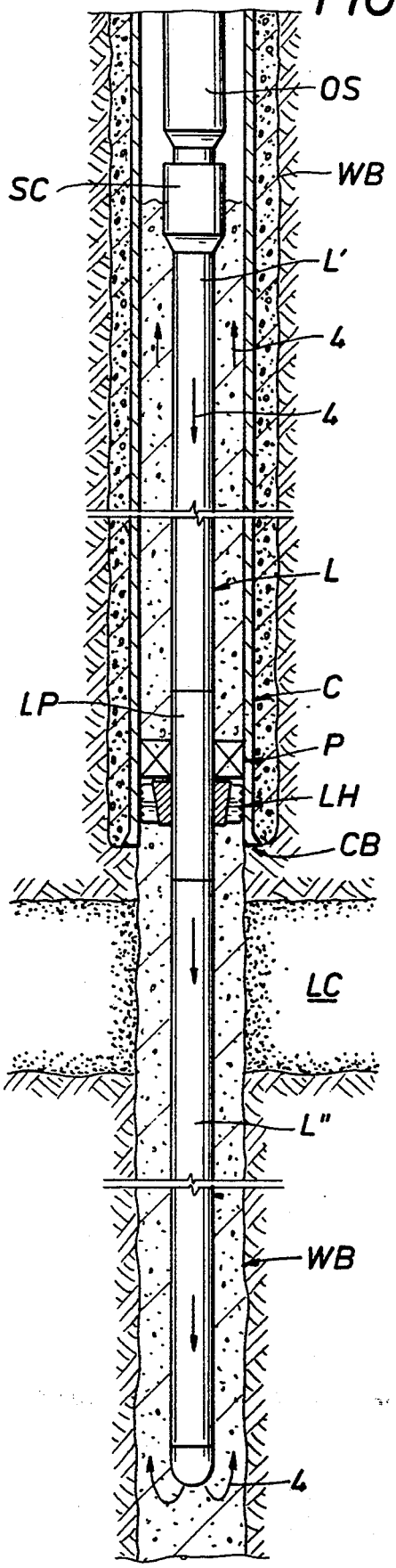
FIG. 2 is a schematic representation showing the arrangement of the present invention for cementing a liner in an overlapped well bore tubular member, such as a casing.

FIG. 2 of the above patent shows one form of a hydraulic operated liner hanger means and FIG. 10 shows one form of a mechanically actuated liner hanger means with a J slot that may be employed with the present invention. This patent is incorporated by reference in its entirety herein as if copied word for word.

U.S. Pat. No. 5,018,579 in FIG. 1 shows one form of catcher means, or landing collar, and set shoe which may be used in the lower end of the liner. The set shoe at the bottom of the liner incorporates a one way acting valve to prevent back flow from the well bore back into the liner. A seat is releasably secured, by any suitable means such as shear pins with the catcher means for receiving a plug such as a ball valve to close off flow out the lower end of the liner when it is desired to conduct fluid through the operating string and into the liner to set the liner hanger means hydraulically. The pressure is increased to shear the pins and release the seat and plug from the catcher means, and the seat has slots or ports there through to accommodate flow of cement out the lower end of the liner L to cement the liner in a well bore as will be described. This patent is also incorporated herein by reference in its entirety as if copied word for word.

Attention is first directed to FIG. 1 wherein the normal present manner of securing and cementing a liner in position in a well bore tubular member is shown. The well bore is represented generally at WB, the casing at C and cement is shown between the casing and well bore. The bottom, or lower end of the casing is shown at CB.

An operating string OS is releasably connected with the liner, represented generally at L on which is supported liner hanger means referred to generally at LH and packer means P. The liner hanger and packer means have heretofore been set in the casing C adjacent the upper end of the overlap of the casing C with the liner L as illustrated schematically in FIG. 1. This position of the hanger means and packer illlustrated in FIG. 1 may be anywhere from several hundred to a thousand feet or more feet above the lower end CB of the casing as illustrated in FIG. 1 of the drawings.

Cement is then conducted through the operating string, liner and into the well bore, as represented by the arrows I in FIG. 1, to surround the liner in the well bore which extends below the lower end of the casing as shown and packer means are locked to prevent premature engagement with a well bore tubular member while the foregoing operations are conducted.

Where a lost circulation zone, represented at LC exists, it has been found that the cement, represented at CD, which is deposited in the space between the liner and well bore wall underneath packer P escapes into the lost circulation zone LC as represented by the arrows 2 in FIG. 1. This destroys or at least interrupts the seal which it is desired to establish in the space between the casing and liner by the cement deposited therein.

The present invention overcomes this problem in that it enables the liner hanger means and weight set packer means to be selectively, or independently set, any place in the longitudinal extent of the liner overlap even though weight is applied to the packer means during manipulation of the liner by the operating string OS that is releasably connected, as previously described, with the liner part L′ or liner portion LP.

The present invention is shown and described as being manipulated from an elevation which is remote to the liner hanger LH and the packer P supported on the liner portion LP which are illustrated as set in close proximity to the lower end CB of the casing C , which is also the lower end of the overlapped relationship of the liner L and the casing C, or well bore tubular member, as schematically shown in FIG. 2.

Cement may be discharged through and from the liner L , as represented by the arrows 4 to flow out and around the liner L and above the set liner hanger means and into the annular space between the liner and the casing C above the unset packer means to a desired height as schematically shown in FIG. 2. It is to be noted that the liner hanger means and packer means are remote from the location at which the liner hanger means and packer means are selectively and independently actuated.

The operating string then manipulates the liner, or liner portion to cause unset packer means P to engage with the well bore tubular member at a location below the cement above the packer means in the well bore tubular member, which in this example is the casing C. This traps the cement between the liner and the casing above the lost circulation zone and helps to maintain the cement seal between the liner and the casing C above the packer means P.

The invention is described in detail wherein the well tool, or liner portion represented generally by the letters LP, is shown as positioned adjacent the lower end of the over lap of the casing C with liner L; however the element LP may be positioned at any position within the longitudinal extent of the overlapped liner L, as may be desired, including the position schematically shown in FIG. 1.

Another advantage of the present invention is that in one form an operating string OS releasably connected with the liner L operates to position the liner L so that the liner L is then employed, or manipulated to position the liner L and to conduct the operations.

In another form the operating string is releasably and directly connected with the liner portion, or well tool, LP which enables the operating string to position the liner L and to conduct the operations.

Figure 2A:
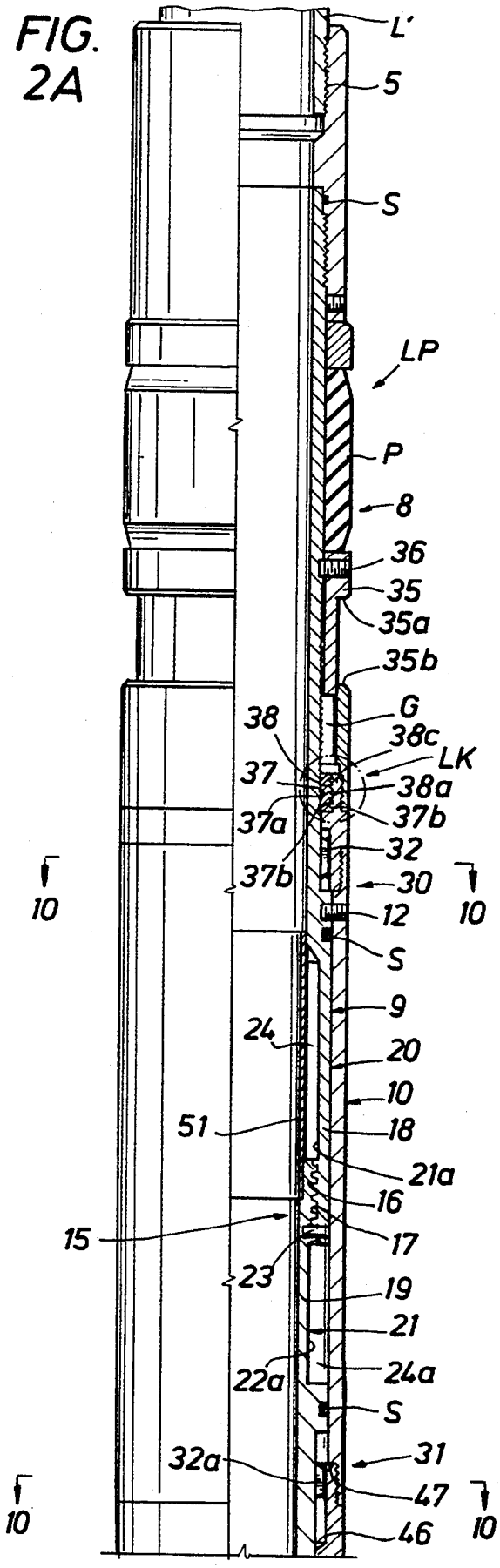
FIG. 2A is a quarter sectional view of the upper end portion of the well tool, or liner portion, of the present invention with packer means supported thereon.
Figure 2B:
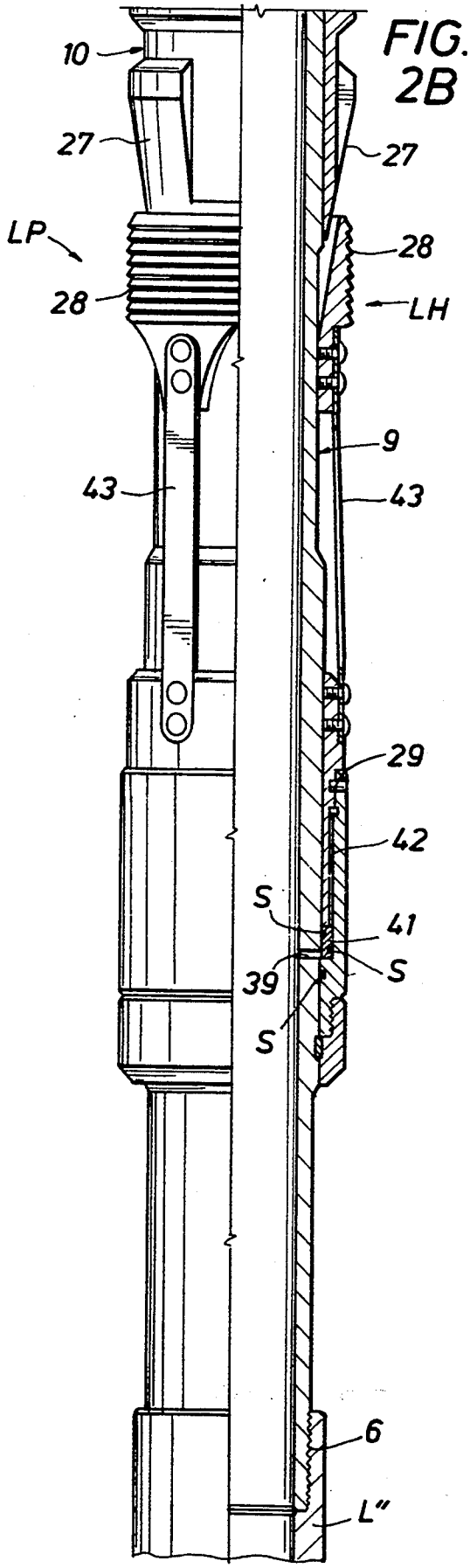
FIG. 2B is a continuation quarter sectional view of FIG. 2A showing liner hanger means supported on the well tool, or liner portion, in unset position.
Figure 3:
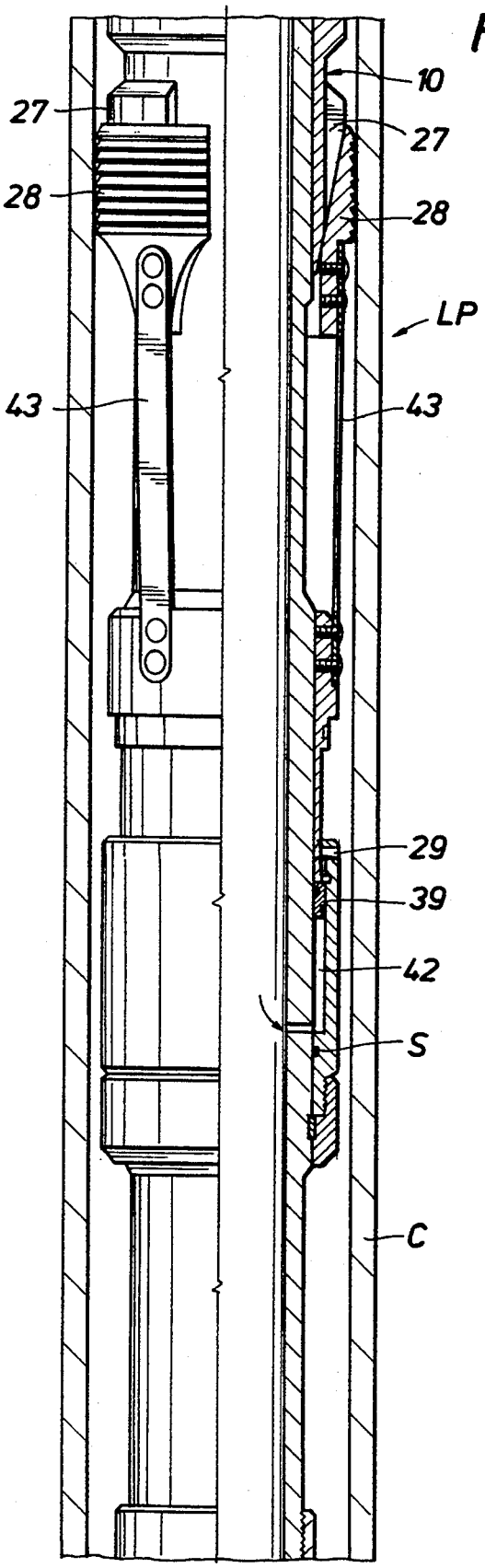
FIG. 3 is a continuation quarter sectional view of FIG. 2B showing the liner hanger means in set position with a well bore tubular member, such as a casing.

Attention is first directed to FIGS. 2A and 3 of the drawings wherein the well tool, or liner portion is represented generally by the letters LP. When the liner portion LP is connected intermediate the ends of a liner L as shown schematically in FIG. 2, the threads 5 shown in FIGS. 2A, 5, and 7 at an upper end of liner portion LP connect with the remainder L′ of the liner L extending there above and the threads 6 at the lower end of liner portion LP connect with the remainder L″ of the liner L extending there below, as shown in FIG. 2B.

Liner portion, or well tool LP, includes a tubular mandrel, referred to generally at 8 formed by an inner tubular mandrel and an outer tubular mandrel referred to generally at 9 and 10, respectively.

Liner hanger means referred to generally at LH in FIG. 2B include cone segments 27 circumferentially spaced on the outer tubular mandrel 10 and circumferentially spaced slip segments 28 which slip segments are releasably supported on the inner mandrel 9 by releasable connection means, shown as being in the from of a frangible member, such as by way of example only, shear pin 29, connected with members 43 on which slip segments 28 are secured. The frangible member may be a shear ring or any other type of shear element.

The inner and outer tubular mandrels 9 and 10 are connected together against relative longitudinal movement by first releasable connection means shown as being a frangible member 12, which may be a shear pin, shear ring or any other type of shear element.

The inner and outer tubular mandrels 9 and 10 are connected together against relative rotational movement by second releasable connection means shown as being in the from of the spline arrangements referred to generally at 30 and 31.

Figure 7:
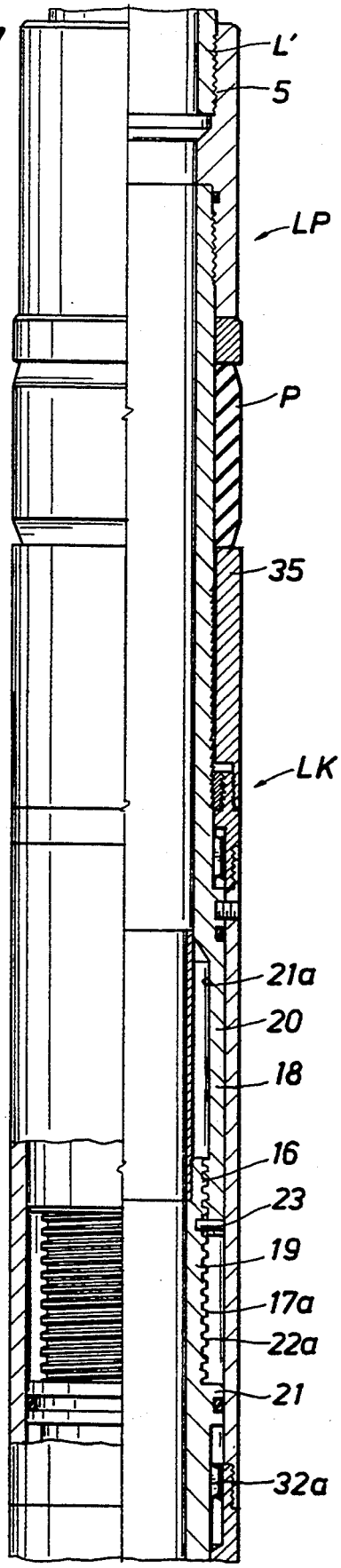
FIG. 7 is a quarter sectional view showing an alternate embodiment of the releasable means which restrains relative longitudinal movement between components.

As better seen in FIGS. 10 and 11, the spline arrangements comprise cooperating keys 32 and key ways 33 formed on the inner and outer tubular mandrels 9 and 10 as illustrated in FIG. 7 which provide, or form projecting radial engageable surfaces 32*a* and 33*a* to prevent relative rotation between inner and outer tubular mandrels 9 and 10. It can be appreciated that the keys and key ways while being shown as formed on the inner and outer tubular mandrels, respectively, may be reversed from that shown.

The upper end of inner tubular mandrel 9 is shown as connected with the liner part L' which has a setting collar SC at its upper end for engagement with an operating string OS. A setting collar SC may be connected with the upper end of liner portion LP for connecting the liner portion with an operating string. The inner tubular mandrel 9 is formed by an upper inner tubular mandrel portion 20 and a lower inner tubular mandrel portion 21.

The upper and lower inner tubular mandrel portions 20 and 21 are releasably connected together by third releasable connection means which is shown as comprising a threaded connection referred to generally at 15 in the FIG. 2A form. The releasable threaded connection 15 is secured against release by frangible member 23 shown as a shear pin extending through the threaded connection 15.

This arrangement enables the operating string OS to be rotated to release the setting nut on the setting tool from the setting collar SC connected on the upper end of the liner part L', or connected on the upper end of the liner portion LP, whichever is connected to the operating string, without disconnecting the threaded connection 15, and preventing premature setting of packer means P.

The threaded connection 15 comprises threads 16 and 17 to form threaded portions that are immediately adjacent the ends of each of the end portions 18 and 19, respectively, of each the upper and lower inner tubular mandrel portions 20, and 21, respectively.

Unthreaded, or blank portions 21*a* and 22*a* are provided on each the upper and lower end portions 18 and 19 of the inner upper and lower inner tubular mandrels 20 and 21. A sleeve 51 in the bore of the inner tubular mandrel is radially spaced from the blank portion 21*a* on the inner upper tubular mandrel portion 20. The inner surface of the outer tubular member 10 is radially spaced from the blank surface 22*a* adjacent the lower end portion 19 which provides annular void spaces 24 and 24*a*, respectively, to receive the threaded portions formed by threads 16 and 17 on end portions 18 and 19 after they are disconnected from each other, as better illustrated in in FIGS. 5 and 6. This arrangement accommodates relative longitudinal movement between the disconnected upper inner and lower inner tubular member end portions 18 and 19 of the inner tubular member 9, upon relative rotation and longitudinal movement between the inner upper mandrel portion 20 and lower tubular mandrel portion 21 to secure packer means P with the well bore tubular member C as seen in FIG. 6, and as will be described.

In the FIG. 2A form, the packer means P is set, or secured with the well bore tubular member C after the liner has been hung on the casing C by the liner hanger means LH. The liner part L' and upper inner tubular mandrel portion 20 are rotated relative to the lower inner liner portion 21 to disconnect the threads 16 and 17 which form threaded portion 15. The operating string is slacked off and weight applied, if necessary, to move the inner upper tubular mandrel portion 20 longitudinally relative to lower inner tubular mandrel portion 21, as better seen in FIGS. 5 and 6.

Where the liner part L' is omitted, the operating string OS with a setting tool thereon may be releasably connected directly with a setting collar connected with the threads 5 at the upper end of the liner portion LP. Rotation of the upper inner mandrel portion 20 of liner portion LP by the operating string OS effects disconnection of threads 16 and 17 for applying weight to the liner portion LP by lowering the operating string, if necessary to set the packer P in the casing C.

The packer means P is releasably supported on the inner mandrel 9 by sleeve means 35. In the FIG. 2A form, the sleeve means 35 is releasably connected to the inner mandrel 9 by fourth releasable connection means, shown in FIG. 2A, by way of example only, as being a shear pin 36.

Figure 8:
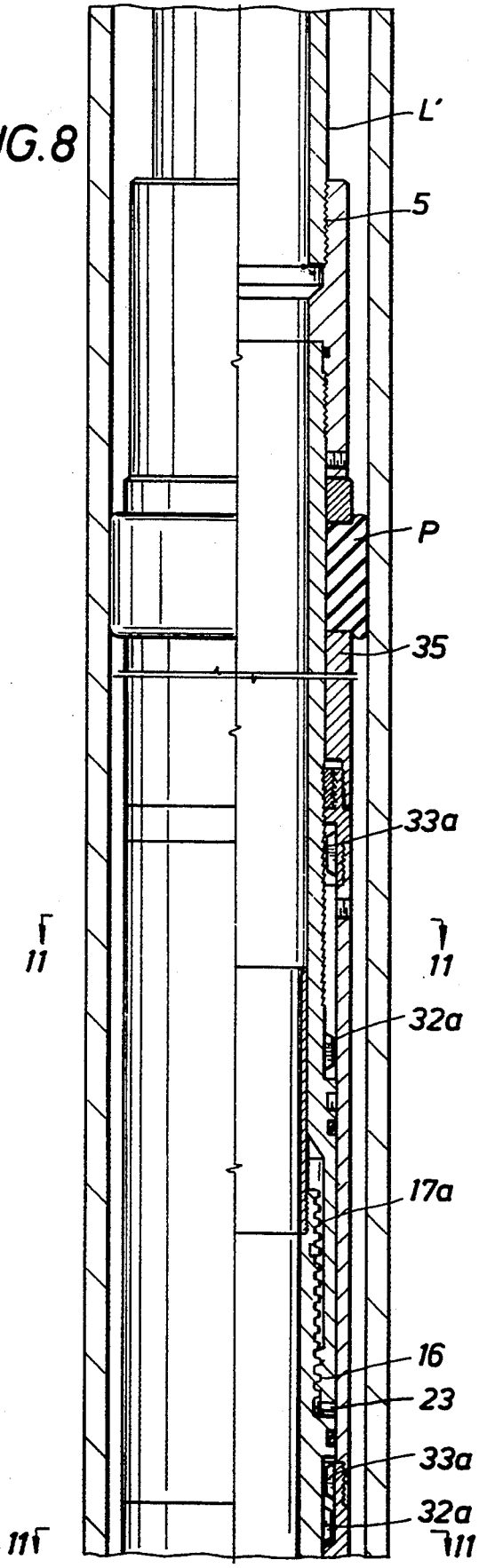
FIG. 8 is a quarter sectional view similar to FIG. 6 showing the relationship of the well tool components of the alternate embodiment of FIG. 7 wherein the packer means is engaged with the overlapping well bore tubular member means by rotation only.

Attention is directed to FIGS. 7 and 8 of the drawings where an alternate from of the invention is shown wherein the upper inner tubular mandrel end portion 18 is blank, as again represented at 21*a*, except for the threads 16 adjacent the end of the end portion . The lower inner tubular mandrel end portion 19 is provided with threads 17*a* throughout its longitudinal extent as shown to threadedly receive the threads 16 on the end portion 18 of the upper inner tubular mandrel as the upper inner mandrel portion 20 is rotated relative to the lower inner mandrel portion 21. In this form, the packer P is set only by rotation, as will be described herein.

Suitable lock means, represented generally at LK in the drawings, the structure and function of which is well known in the art, maintain the packer means secured with the well bore tubular member. The lock means LK is provided by the ratchet threads 37*a* on the outer periphery of the upper inner mandrel portion 20, inner threads 37, outer threads 37*b* on split ratchet ring 38 and threads 38*a* on upper end portion 38*c* of outer mandrel 10.

The operating string OS includes a mandrel, or setting tool which extends into and is releasably connected by threads with a setting collar as previously stated and as shown and described in U.S. Pat. No. 4,834,185. The setting collar is connected by threads 5 at the upper end of the liner part L'. In some instances, the liner portion LP may be at the upper end of the liner L, and in this event, it will be releasably connected by threads 5 at its upper end to a setting collar which releasably connects with the setting tool on operating string OS in the same manner as above stated with regard to liner part L'.

Seal means, preferably of a retrievable form as shown in U.S. Pat. No. 4,281,711, which patent is incorporated herein by reference as if copied word for word, extends between and seals off between the operating string and the liner part L', or between the operating string and liner portion LP. Suitable clutch means in the form of rigid splines are provided on the mandrel M, or setting tool, of the operating string OS and on liner part L' or liner portion LP as shown and described in U.S. Pat. No. 4,834,185.

The liner L including the liner portion LP is lowered into a well bore tubular member C by the operating string and setting tool to the desired position within the overlap between casing C and liner L and the liner hanger means is actuated to secure the liner hanger with the well bore tubular member, or casing C.

Where the liner is to be set in position in casing C in the overlap as illustrated in FIG. 1 of the drawings, the operating string setting tool may be directly connected with a setting collar on the upper end of the liner portion LP, or with the upper end of a short liner part connected with the upper end of liner portion LP.

After the liner L, with the liner portion LP connected at some location intermediate the ends of liner L, or adjacent an end of liner L, is lowered into the desired position in the liner overlapped by the well bore tubular member, it may be rotated and reciprocated to condition the well bore in a manner well known in the art. The liner part L' or the liner portion LP, which ever is connected with the setting collar, is manipulated by the operating string to set the liner hanger on the liner portion LP with the overlapping well bore tubular member.

Either a hydraulic actuated liner hanger or mechanical actuated liner hanger, the construction and function of each of which is well known to those skilled in the art, may be employed to set the liner in the casing. A hydraulic liner hanger as shown in in FIGS. 2B and 3 of the drawings is employed by way of example only. A ball, or other closure is pumped down the operating string and liner to engage the landing collar in the lower end portion of the liner L.

U.S. Pat. No. 5,018,579, FIG. 19 shows a set shoe at the bottom of a liner with a one way valve therein to prevent flow from the well bore back into the liner. The landing collar is secured in the liner there above and a seat is provided for receiving a ball thereon to close off flow through the liner, when desired.

The seat is releasably secured by shear means in the landing collar and the seat has slots or ports therein so that when it is desired to flow though the liner, the pump pressure may be increased to release the shear means and move the seat and ball to the set shoe. The slots in the seat enable flow to occur through and out the set shoe to the well bore.

A port 39 in the inner mandrel 9, as shown in FIG. 2B communicates fluid from the inner mandrel bore, after the ball is dropped to rest on the seat, to act on the piston 41 which has seals S thereon. The piston 41 abuts the lower end of the circumferentially spaced members 43 on which the slip segments 28 are mounted, and the piston 41 is forced upwardly in annular space 42 in inner mandrel 9.

The shear pin 29 connects the members 43 to the inner mandrel 9 and upward movement of member 43 shears shear pin 29 and releases the members 43 and connected slip segments 28 for upward movement in response to movement of the piston 41 by fluid pressure in the liner to engage slip segments 28 with circumferentially spaced cone segments 27 on outer tubular member 10. This forces the slip segments 28 in engagement with the well bore tubular member C as shown in FIG. 3 of the drawings. The cone segments 27 are on the outer mandrel 10 so that is it secured to the casing C when the slip segments 28 engage the casing C.

The inner mandrel 9 is, at this time, connected to the outer mandrel 10 by the shear pin 12 and by the threads 16 and 17 on the end portions of the upper inner mandrel portion 20 and the lower inner mandrel portion 21.

After the liner hanger means LH are contacted with the overlapping well bore tubular member as above described, the operating string is slacked off, or lowered, so that the weight of the liner including inner mandrel 9 and outer tubular member 10 of the liner causes the liner to move down to engage the slips 28 on outer tubular member 10 with liner hanger LH.

When the operating string OS supporting the liner is lowered, the weight of the operating string and the liner moves the inner mandrel 9 of the liner portion LP down relative to outer mandrel 10, which outer mandrel is seated on the liner hanger LH, until shoulder 46 on inner tubular member 9 engages shoulder 47 on outer tubular member 10. These engaged shoulders support and transfer the weight of the liner L to the casing C by the liner hanger means LH.

The above longitudinal movement of inner tubular mandrel 9 relative to outer tubular mandrel 10 shears pin 12 adjacent the spline arrangement 30 on inner upper tubular mandrel portion 20 and surrounding outer tubular mandrel 10. Shear pin 12 is the first releasable connection means releasably connecting the inner tubular mandrel 9 and the outer tubular mandrel 10 against relative longitudinal movement.

Figure 4:
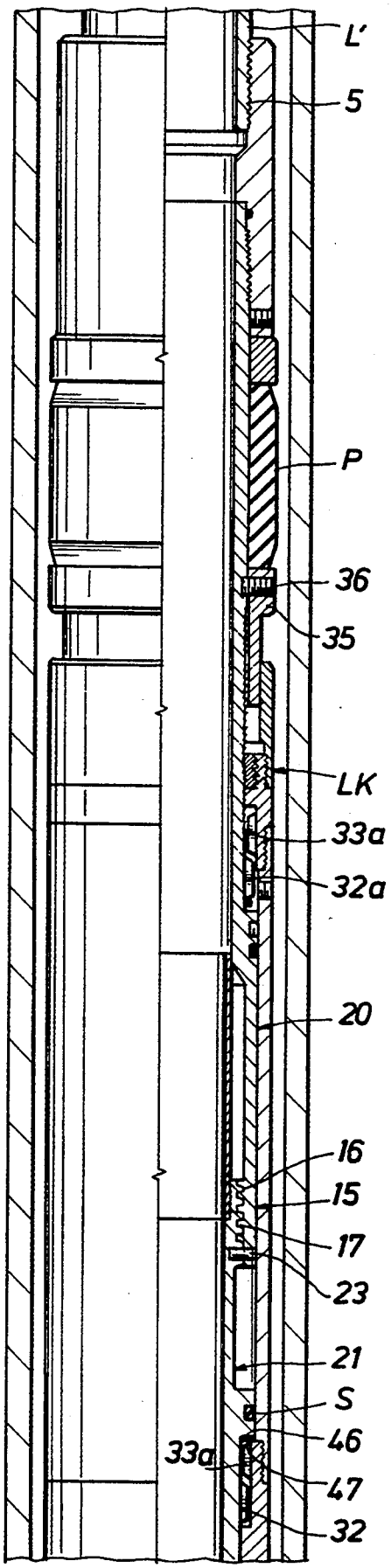
FIG. 4 is a quarter sectional view similar to FIG. 2A and showing the packer means retained retracted on the well tool after the liner hanger means is set as shown in FIG. 3 which permits weight to be set down on the liner and the operating string slacked off to support the liner on the liner hanger means which disengages spline means that locks the liner tool components against relative rotation and release means which permit relative longitudinal movement between well tool components.

Spline arrangement refered to generally at 31, as seen in FIG. 2A, is on inner lower tubular mandrel portion 21 and on surrounding outer tubular mandrel 10. Both spline arrangement 30 and spline arrangement 31 include the longitudinally extending, radially projecting surfaces 32*a*, 33*a*, respectively, on the inner and outer tubular members 9 and 10, and when inner tubular member 9 is shifted down relative to outer tubular member 10, the projecting surfaces 32*a* and 33*a* of the spline arrangements 30 and 31 become disengaged as shown in FIG. 4.

The spline arrangements 30 and 31 which form the second releasable connection means releasably connect the inner tubular member 9 and the outer tubular member 10 against relative rotation and when released permit relative rotation between the tubular members 9 and 10.

The longitudinal movement of the inner tubular mandrel 9 relative to outer tubular mandrel 10 does not release the threaded connection 15 nor frangible member 23 extending therethrough.

The inner tubular member, formed by the inner upper tubular mandrel portion 20 and the inner lower tubular mandrel portion 21 remain connected by the releasable threaded connection 15 and the frangible means 23 extending through the threaded connection 15 to maintain the packer means P secured, or locked against premature engagement of the packer means P with the well bore tubular member C.

It is desirable to disconnect the operating string OS from the liner L before cementing operations to avoid cementing the operating string in the well bore in the event of some malfunction during the cementing procedure.

Right hand rotation of the operating string and setting tool which is connected with the setting collar releases the setting tool and the operating string from the setting collar which may be connected to the liner section LP or L'. The third releasable connecting means which is threaded connection 15 that includes the frangible member 23 extending there through maintains the threaded connection 15 engaged while the operating string OS is rotated to the right to disengage from the liner part L' or the liner portion LP.

It is generally the practice at this point in the operation to lift up the operating string and check the weight in a manner well know in the art to assure that the operating string has been released from liner part L' or liner portion LP. The operating string is then set down on the liner part L40 or liner portion LP without connecting therewith, but to maintain communication there with for conducting cement to and through the liner L and to the casing C in the well bore.

U.S. Pat. No. 5,018,579 discloses a method and apparatus for conducting cementing operations and is incorporated herein by reference in full, as if copied word for word. The cement is discharged down the liner with liner wipers and plugs, it being well known to those skilled in the art how to determine the volume of cement to be pumped into position in the annular space between the liner L and the well bore tubular member and the open bore hole extending beneath, or below the bottom end CB of the casing C.

The packer means P is then actuated to engage and lock in engagement with the overlapping casing C. This is accomplished in the FIG. 2A form by releasably engaging the clutch means on the setting tool that is supported on the operating string with the clutch means on the setting collar as described in U.S. Pat. No. 4,843,185 that is connected with the liner part L' or the liner portion LP, whichever is at the top of the liner L. The operating string OS is then rotated which imparts rotation to the liner part L' or the liner portion LP, which ever is at the top of the liner L. This rotates the upper inner tubular mandrel portion 20 relative to the lower inner tubular mandrel portion 21. Rotation of the inner upper liner portion 20 relative to the lower liner portion 21 may be effected since splines 30, 31 have been previously disengaged, and the weight of the liner on the liner hanger and casing C will maintain the lower inner tubular portion 21 stationary while the upper inner tubular portion 20 of the liner portion LP is rotated as the operating string rotates. The relative rotation between the upper and lower inner tubular portions 20 and 21 shears frangible member 23.

Figure 5:
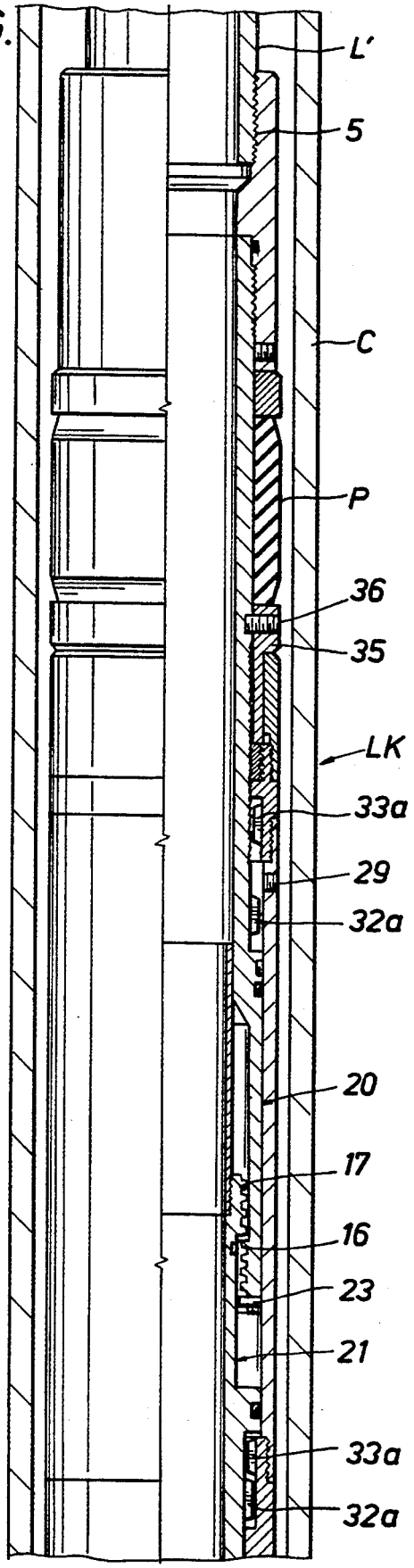
FIG. 5 is a quarter sectional view similar to FIG. 4 showing the packer means on the well tool retained in retracted position, the liner supported on the liner hanger means and release of tool components by rotation of the liner for relative longitudinal movement there between which enables the packer means to be set by weight.
Figure 6:
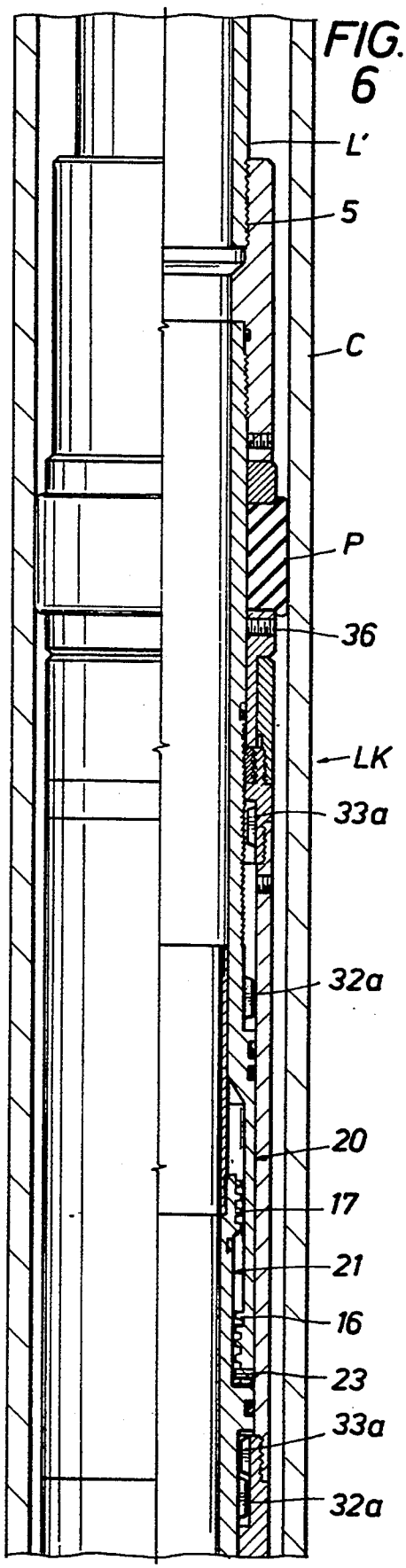
FIG. 6 is a quarter sectional view similar to FIG. 5, but showing the position of the tool components when the operating string is slacked off and weight applied to compress the packer means and expand it into engagement with the surrounding, or overlapping, well bore tubular member.

Continued rotation of the upper inner mandrel portion 20 relative to the lower inner mandrel portion 21 and remainder of the liner supported on the liner hanger moves the threads 16 on upper inner liner mandrel portion 20 downwardly along the threads 17 on the lower inner liner mandrel portion 21 until they disengage, or disconnect, as shown in FIG. 5. Weight can then be applied by the operating string to the inner mandrel 9, if necessary, to move it longitudinally downwardly to to set the packer P as seen in FIG. 6.

A fourth releasable connection means in the form of frangible member 36 that supports sleeve 35 on the inner mandrel 9 in the FIG. 2A form is sheared by applying weight to the operating string. The weight applied to inner tubular mandrel 9 moves sleeve 35 and packer means P down on the inner tubular mandrel 9 so that sleeve 35 telescopes into gap G until surface 35*a* on the sleeve 35 contacts the upper end 35*b* of outer tubular member 10.

The ratchet surface 37 on the outer periphery of the inner tubular member 9, the ratchet surfaces 37*a* and 37*b* on the split ring 38 along with the threaded surface 38*a* on the member 38*c* accommodate relative longitudinal downward movement of the inner tubular mandrel 9 as weight is applied by the operating string to set the packer means P with the casing C.

The ratchet surfaces, in a manner well known in the art, lock when the packer means P is fully compressed and engaged with the well bore tubular member C as shown in FIG. 6. to maintain the packer means P secured with the casing C. From the foregoing, it is seen that the packer means P of this form is set by a combination of rotation of the liner part L', or liner portion LP and setting weight thereon.

After the cement has been discharged into the well bore and into the annular space between the casing and liner and the packer means set and secured with the well bore tubular member, reverse circulation down the annular space between the casing and operating string may occur to clean out, or remove any unset cement from the annular space between the casing C and the operating string OS.

FIGS. 7 and 8 eight show a form of the invention wherein the fourth releasable connection in the form of shear pin 36 is omitted, as is gap G. In this form the packer means P is set only by rotation of the liner part L', or liner portion LP, which ever is connected with the operating string.

Threads 17*a* on lower inner end portion 22*a* of inner tubular mandrel portion 21 are continuous, and the threads 16 on the upper inner tubular mandrel portion 21 are just immediately adjacent the end of end portion 21 while the remainder 21*a* of the inner surface of end portion 21 of inner upper mandrel portion 21*a* is unthreaded as described with regard to the FIG. 2A form.

Rotation of the operating string OS threads upper inner mandrel portion 20 down over lower inner mandrel portion 21 and will cause the packer means to extend outwardly and secure and lock with the well bore tubular member.

In this form, the packer P begins to move toward setting position as soon as relative rotation between the upper inner mandrel portion 20 and lower inner mandrel portion 21 occurs after shear pin 23 is sheared to permit relative rotation between inner upper mandrel portion 20 and inner. lower mandrel portion 21

The same ratchet lock arrangement LK as described with regard to FIG. 2A is used with this form. Suitable seal means S may be placed in the well tool, or liner portion LP where ever it may be deemed desirable. The sleeve 51 adjacent end portion 18 of inner upper mandrel portion 20 provides a more uniform diameter in the bore of the inner mandrel 9.

The present invention maintains the packer retracted until it is desired to set it in the casing even though compresion, tension or torque is applied to the well tool which supports the packer.

The foregoing description of the invention is illustrative and explanatory thereof, and various changes in the details of the illustrated construction may be made without departing from the spirit of the invention as defined in the following claims.

What is claimed is:

1. A method of securing a liner in an overlapping well bore tubular member wherein the liner is releasably connected with an operating string and wherein the liner includes packer means and liner hanger means thereon comprising the steps of lowering the liner into the well bore tubular member;

manipulating the liner at a location remote from the liner hanger means to secure the liner hanger means with the overlapping well bore tubular member while maintaining the packer means secured against engaging the well bore tubular member flowing cement through the liner and out the liner below the packer means and into the overlapping well bore tubular member above the packer means; and manipulating the liner at a location remote from the packer means to engage and secure the packer means with the well bore tubular member to trap cement above the packer means and seal between the liner and the well bore tubular member.

2. The method of claim 1 wherein the liner hanger means is hydraulically actuated and including the steps of:

closing off flow through the liner;

conducting fluid into the liner to secure the liner hanger means with the well bore tubular member; and wherein the manipulation of the liner to engage and lock the packer means includes rotating the liner.

3. The method of claim 1 wherein the liner hanger is mechanically actuated and including the steps of;

manipulating the liner to secure the liner hanger means with the overlapping well bore tubular member while maintaining the packer means secured against prematurely engaging the well bore tubular member; and wherein the manipulation of the liner to engage and lock the packer means includes rotating the liner.

4. A method of securing a liner in an overlapping well bore tubular member wherein the liner includes a liner portion having packer means and liner hanger means thereon and wherein the liner portion is releasably connected with an operating string comprising the steps of:

lowering the liner with the liner portion releasably connected with an operating string thereon into the overlapping well bore tubular member;

manipulating the liner portion to selectively secure the liner hanger means on the liner portion with an overlapping well bore tubular member while maintaining the packer means secured against engaging the well bore tubular member flowing cement through the liner and out the liner below the packer means and into the overlapping well bore tubular member above the packer means; and manipulating the liner to engage and lock the packer means on the liner portion with the well bore tubular member to trap cement above the packer means and seal between the liner and the well bore tubular member.

5. A method of operating a liner releasably secured with an operating string to first secure the liner in an overlapping well bore tubular member by liner hanger means on the liner and then cement the liner in the overlapping well bore tubular member while maintaining packer means on the liner secured to prevent premature engagement with the overlapping well bore tubular member comprising the steps of:

lowering the liner including the packer means and liner hanger means into the overlapping well bore tubular member;

securing the liner hanger means with the overlapping well bore tubular member;

maintaining the packer means secured to prevent premature engagement of the packer means with the overlapping well bore tubular member while securing the liner hanger means with the well bore overlapping tubular member;

flowing cement through the liner and out the liner below the packer means to the overlapping well bore tubular member and above the packer means; and thereafter setting the packer means to trap cement in the overlapping well bore and seal about the liner and above the set packer means.

6. The method of claim 5 including the step of disconnecting the operating string from the liner while maintaining communication therewith prior to flowing cement through the liner and then reconnecting the operating string with the liner after completing the flow of cement through the liner.

7. The method of claim 6 including the steps of:

manipulating the liner by the operating string to engage and lock the packer means with the overlapping well bore tubular member to trap the cement above the packer means.

* * * * *